United States Patent [19]

Valentinsen

[11] Patent Number: 4,915,357

[45] Date of Patent: Apr. 10, 1990

[54] ANCHOR WINCH PERMITTING QUICK ANCHOR DROPPING

[75] Inventor: John Valentinsen, Olso, Norway

[73] Assignee: Industri Lambertseter A/S, Oslo, Norway

[21] Appl. No.: 275,060

[22] PCT Filed: Mar. 18, 1988

[86] PCT No.: PCT/NO88/00022

§ 371 Date: Nov. 18, 1988

§ 102(e) Date: Nov. 18, 1988

[87] PCT Pub. No.: WO88/07021

PCT Pub. Date: Sep. 22, 1988

[30] Foreign Application Priority Data

Mar. 18, 1987 [NO] Norway ..... 871110

[51] Int. Cl.[4] ..... B66D 1/00

[52] U.S. Cl. ..... 254/266; 254/372

[58] Field of Search ..... 254/365, 272, 382, 383, 254/333, 266

[56] References Cited

U.S. PATENT DOCUMENTS

| | | | |
|---|---|---|---|
| 1,762,715 | 6/1930 | Gahagan | 254/365 X |
| 2,704,201 | 3/1955 | Rokins | 254/372 |
| 2,991,976 | 7/1961 | Carroll | 254/372 X |

FOREIGN PATENT DOCUMENTS 2031832 9/1979 United Kingdom .

*Primary Examiner*—Katherine A. Matecki

*Attorney, Agent, or Firm*—Browdy and Neimark

[57] ABSTRACT

A device in connection with an anchor winch for pleasure craft, said winch comprising a drive pulley (5) for an anchor cable (4). In said device part of the circumference of the drive pulley (5) is spanned by lifting member (21) which is rotatable about the axis of said drive pulley and is slip coupled (17–19) with said pulley (5). Stops (22–24) are provided to limit the rotational movement of lifting member (21) between a position outside the sector of engagement of the cable on the drive pulley, and a positive with the lifting member (21) in the sector of engagement and lifting the cable out of drive cooperation with the drive pulley.

6 Claims, 4 Drawing Sheets

ANCHOR WINCH PERMITTING QUICK ANCHOR DROPPING

FIELD OF INVENTION

The invention relates to a device in connection with an anchor winch such as for a pleasure craft, having a reversible drive pulley for an anchor cable.

BACKGROUND

The anchor winches common today for pleasure craft are provided with a manually operated coupling for the drive pulley, permitting the latter to be released from the drive shaft when the anchor is to be dropped and, thus, permitting the anchor to slide out relatively quickly. For pleasure craft, a term which should in the present context comprise other relatively small craft, such an anchor winch is quite satisfactory when used ahead. In most cases there will be no need of dropping the anchor quickly, and the anchor may then be dropped by the aid of the winch with the electromotor of the winch being reversed from the wheel house. Only when it is necessary to drop anchor quickly is the drive pulley released manually. Especially aft it may be necessary to drop anchor quickly. A typical situation demanding quick anchor dropping arises when the anchor is dropped 40–50 m from the shore with the craft moving slowly towards the shore. In such cases it is desired to make fast the craft ahead while the anchor should keep the craft off the shore. There is no time to lose and so the anchor has to be dropped quickly.

SUMMARY

It is an object of the invention to permit quick dropping of the anchor by reversal of the drive motor or release of the pawl lock. According to the invention this is achieved by ensuring that part of the circumference of the drive pulley is spanned by a lifting member which is rotatable about the axis of said drive pulley and is slip coupled with drive pulley, and by stops limiting the rotational movement of lifting member between a position outside the sector of engagement of the cable on the drive pulley, and a position with the lifting member being in the sector of engagement and lifting the cable out of drive cooperation with the drive pulley.

Further features of the invention and its advantages will be disclosed in more detail below in connection with a description of en embodiment shown in the drawings.

DETAILED DESCRIPTION OF INVENTION

Figure 1:
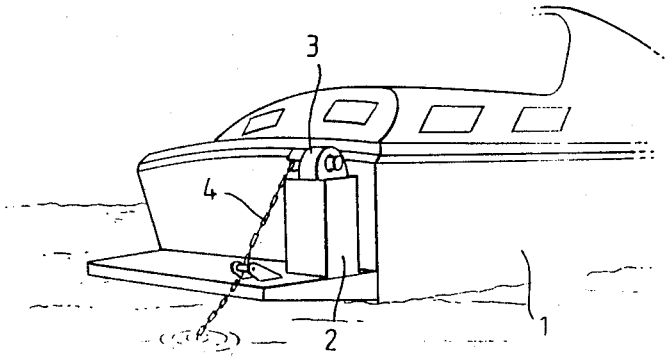
FIG. 1 shows an anchor winch provided aft on a craft.
Figure 2:
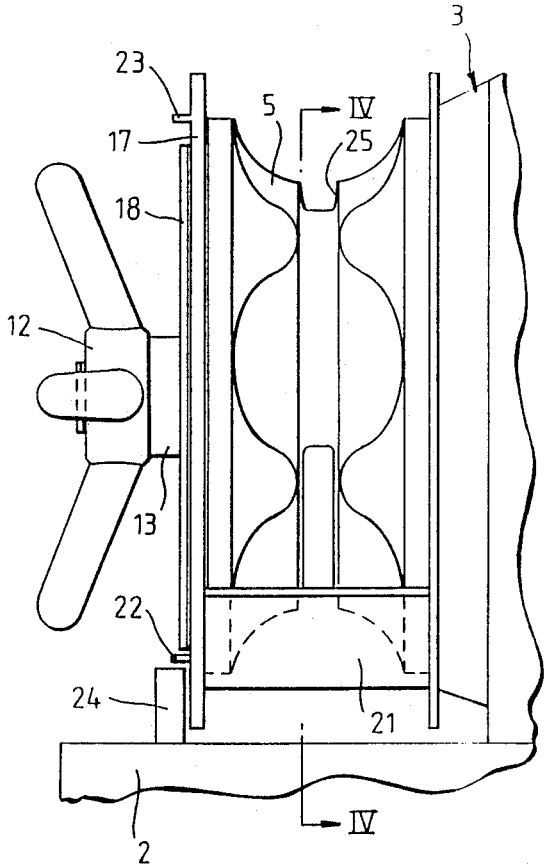
FIG. 2 shows a drive pulley with the invention implemented.
Figure 3:
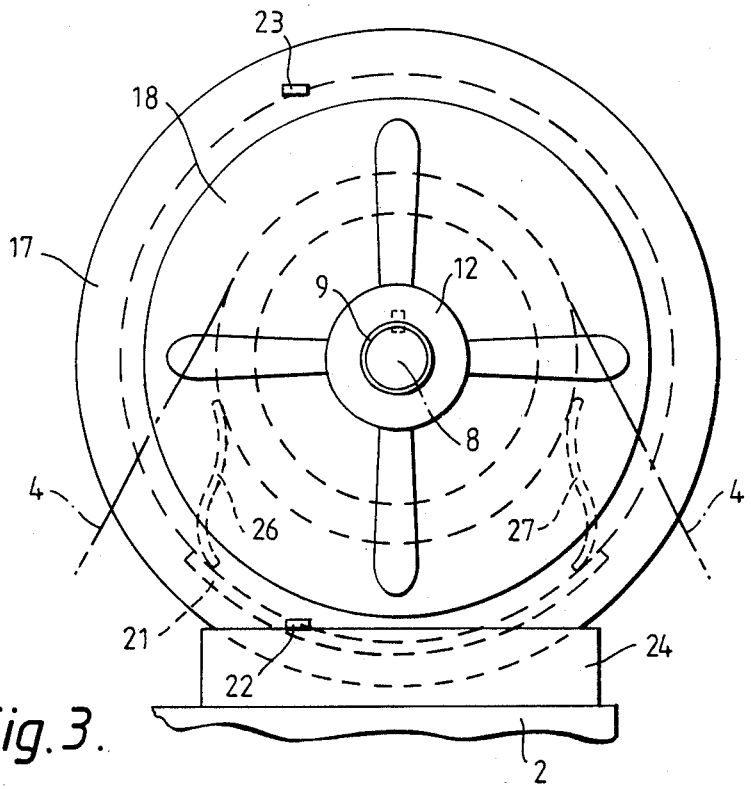
FIG. 3 shows the drive pulley of FIG. 2, as seen from its free side.

In FIG. 1 the stern of a craft 1 is shown with an anchor winch 3 mounted on a chain box 2. Here, the drive pulley is a sprocket wheel, and the anchor cable is a chain 4. Drive pulley 5 is shown in FIGS. 2–7.

Figure 4:
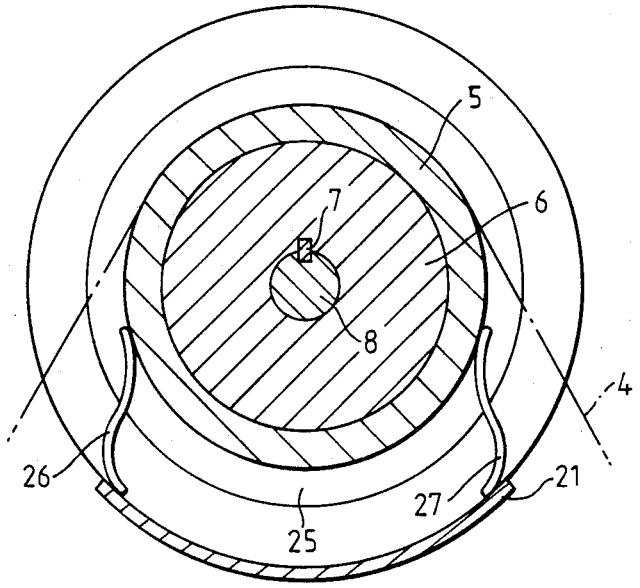
FIG. 4 is a sectional view of the drive pulley along line IV—IV in FIG. 2.
Figure 5:
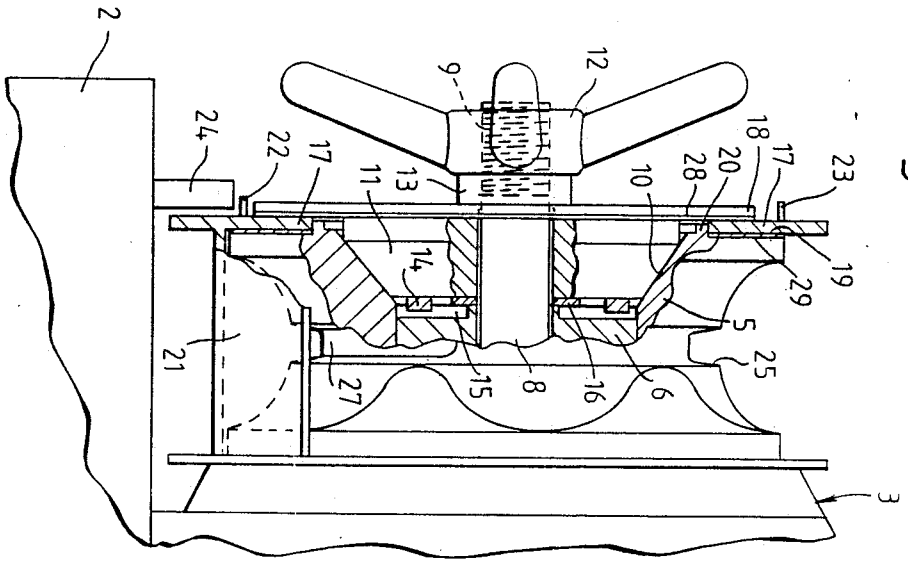
FIG. 5 is an axial section of the drive pulley (with cover).

As shown in FIGS. 4 and 5, a coupling boss 6 is keyed at 7 on a drive shaft 8 which is driven by an electromotor (not shown) on winch 3. Drive shaft 8 is provided with a threaded portion 9 at its outer end. The drive pulley is mounted on boss 6 to be loosely rotatable. The bore in the drive pulley is conically enlarged at 10 towards both sides. A coupling cone 11 is mounted on shaft 8 and can be urged towards cone wall 10 by the aid of a clamp nut 12 which is screwed onto the threaded portion 9 with a ring 13 inserted between said parts. Coupling cone 11 is provided with axial teeth 14 entering into radial grooves 15 in the end wall of boss 6. Between the coupling cone and the boss a spring washer 16 is provided. In the shown position drive pulley and drive shaft are drive coupled.

An annular disk 17 is mounted between a plate or disk collar 18 on coupling cone 11 and flank 19 of the drive pulley. Plate collar 18 urges the annular disk 17 towards flank 19, but only so much that a slip coupling is provided. Between plate collar 18 and annular disc 17, respectively between annular disc 17 and flank 19, friction plates 28, 29 of plastic material are placed. Annular disc 17 is rotatably mounted on a small annular edge 20 on the flank of the drive pulley. Annular disc 17 carries a lifting member 21 in the shape of a domed plate which spans, or extends over a sector of the circumference of the drive pulley. Projecting from annular disc 17 are two stops 22 and 23 which cooperate with a stop 24 mounted on top of chain box 2. In FIGS. 2–5 lifting member 21 is in a neutral position, i.e. the lifting member is out of the engagement sector of the chain. Chain 4, thus, can be hauled in without interference from the lifting member. The lifting member will not be able to come with the rotational movement of the drive pulley because stop 22 contacts stop 24.

Figure 6:
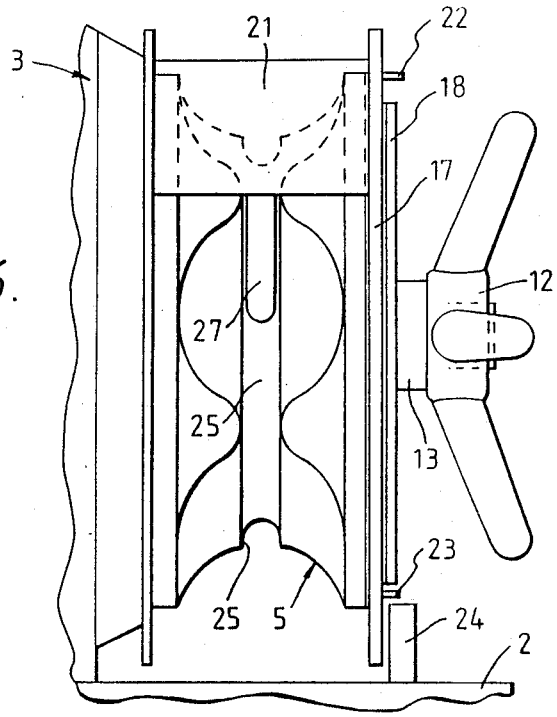
FIG. 6 shows the drive pulley, in FIG. 2, from the other side, with the lifting member in a lifting position.
Figure 7:
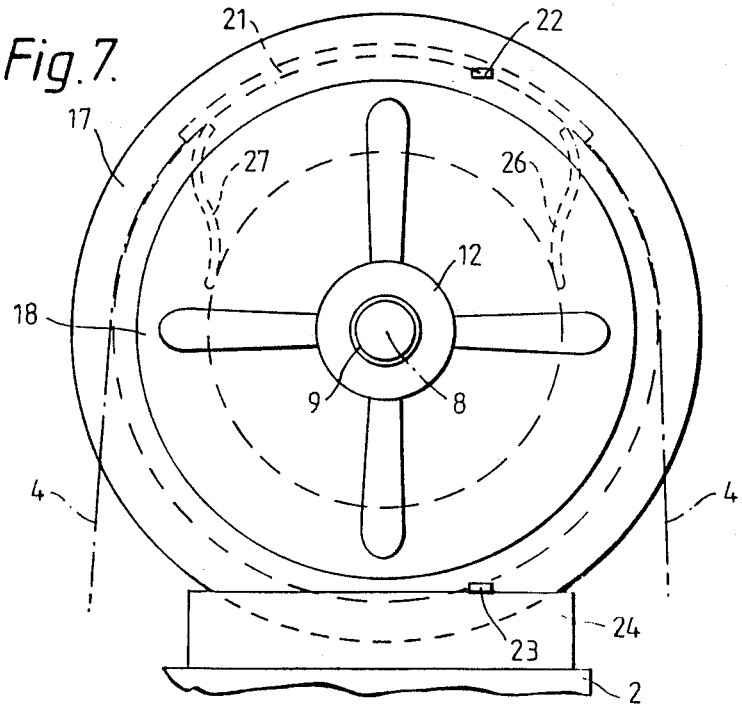
FIG. 7 is a sectional view like FIG. 3, but with the lifting member in a lifting position.

If the motor is reversed drive pulley 5 will rotate in the opposite direction to pay out anchor chain. Due to the slip connection annular disk 17 and, thus, the lifting member will be taken along until stop 23 contacts stop 24. Now, lifting member 21 will positioned as shown in FIGS. 6 and 7, i.e. spanning the engagement sector of the chain and it will lift the chain out of drive connection with the drive pulley, in the present case sprocket wheel 5. The chain can now slide out freely.

As shown, the lifting member is guided in drive pulley groove 25 by two arms 26 and 27. Lifting member 21 is in contact with the circumference of the drive pulley.

Obviously, the invention can also be utilized for anchor ropes with a drive pulley correspondingly designed. A friction reducing coating can be provided between the drive pulley and the lifting member.

I claim:

1. An anchor winch for pleasure craft comprising a reversible drive pulley (5) for an anchor cable which engages a sector of said drive pulley, the drive pulley (5) having an axis and a circumference, part of said circumference being spanned by a lifting member (21), means for rotatable mounting of the lifting member (21) about the axis of said drive pulley (5), means (17–19) for slip coupling of said lifting member (21) with said drive pulley (5), stop means (22–24) for limiting the rotational movement of said lifting member (21) between a first position outside said sector of engagement of the anchor cable on the drive pulley (5) and a second position whereat the lifting member spans a portion of the circumference of the pulley coincident with the sector of engagement of the anchor cable, and wherein said lifting member (21) comprises lifting means for lifting the anchor cable out of drive cooperation with the drive pulley in said second position.

2. A device as defined in claim 1, characterized in that the drive pulley (5) is a sprocket and the anchor cable (4) is a chain.

3. A device as defined in claim 1, characterized in that said lifting member (21) is in sliding contact with the circumference of the drive pulley.

4. A device as defined in claim 3, further comprising a friction reducing coating between the drive pulley and the lifting member.

5. A device in accordance with claim 1 wherein said means for slip coupling of said lifting member (21) with said drive pulley (5) comprises an annular disc (17) connected with said lifting member (21), a member (18) displaceable along said axis of said drive pulley (5) and rotatably coupled to said drive pulley, said member having an end surface (19), and means for urging said annular disc (17) toward said end surface (19), and said means for rotatable mounting of the lifting member comprises a surface on the drive pulley on which the annular disc is rotatably mounted.

6. A device as defined in claim 5, further comprising a drive shaft for said pulley, and wherein said displaceable member (18) pulley (5) with its drive shaft (8).

* * * * *